US006939416B2

(12) United States Patent
Benedictus et al.

(10) Patent No.: US 6,939,416 B2
(45) Date of Patent: Sep. 6, 2005

(54) WELDABLE HIGH STRENGHT AL-MG-SI ALLOY

(75) Inventors: Rinze Benedictus, Delft (NL); Guido Weber, Andernach (DE); Alfred Johann Peter Haszler, Vallendar (DE); Christian Joachim Keidel, Montabaur (DE)

(73) Assignee: Corus Aluminium Walzprodukte GmbH, Koblenz (DE)

( * ) Notice: Subject to any disclaimer, the term of this patent is extended or adjusted under 35 U.S.C. 154(b) by 121 days.

(21) Appl. No.: 10/191,992

(22) Filed: Jul. 10, 2002

(65) Prior Publication Data

US 2003/0087123 A1 May 8, 2003

(30) Foreign Application Priority Data

Jul. 23, 2001 (EP) ..... 01202803

(51) Int. Cl.[7] ..... C22C 21/08
(52) U.S. Cl. ..... 148/417; 420/534; 420/535
(58) Field of Search ..... 148/417; 420/534, 420/535, 553

(56) References Cited

U.S. PATENT DOCUMENTS

| | | | | |
|---|---|---|---|---|
| 4,477,011 | A | 10/1984 | Austin | |
| 4,589,932 | A | 5/1986 | Park | |
| 5,292,595 | A | 3/1994 | Yamauchi et al. | |
| 5,525,169 | A | 6/1996 | Murtha | |
| 5,690,758 | A | 11/1997 | Oh et al. | |
| 5,858,134 | A | 1/1999 | Bechet et al. | |
| 5,888,320 | A | 3/1999 | Dorward | |
| 6,153,854 | A * | 11/2000 | Haszler et al. | 219/121.64 |
| 6,261,706 | B1 | 7/2001 | Fukuda et al. | |
| 6,302,973 | B1 | 10/2001 | Haszler et al. | |

FOREIGN PATENT DOCUMENTS

| | | |
|---|---|---|
| CH | 192161 | 7/1937 |
| DE | 3332656 | 10/1984 |
| DE | 69307553 | 5/1997 |
| DE | 69502508 | 9/1998 |
| DE | 69418855 | 10/1999 |
| DE | 19823472 | 12/1999 |
| DE | 69519012 | 5/2001 |
| DE | 69805527 | 11/2002 |
| DE | 69430622 | 12/2002 |
| DE | 69901905 | 1/2003 |
| EP | 0173632 | 3/1986 |
| EP | 0623462 | 11/1994 |
| GB | 1255423 | 12/1971 |
| JP | 50-005212 A * | 1/1975 |
| JP | 61157831 | 6/1988 |
| JP | 5156398 | 6/1993 |
| JP | 10265883 | 10/1998 |
| SU | 1657538 | 6/1991 |
| WO | 9514113 | 6/1995 |
| WO | 0037702 | 6/2000 |

OTHER PUBLICATIONS

"Aluminum and Aluminum Alloys", ASM International, 1993, pp. 72–73.*
"Metals Handbook: Desk Edition", 2nd ed., ASM International, (1998) pp 40, 445, 450.*
"Aluminum and Aluminum Alloys", ASM International (1993), pp 22–23, 43.*

(Continued)

*Primary Examiner*—George Wyszomierski
*Assistant Examiner*—Janelle Morillo
(74) *Attorney, Agent, or Firm*—Stevens, Davis, Miller & Mosher, LLP

(57) ABSTRACT

The invention relates to a weldable, high-strength aluminium alloy wrought product, which may be in the form of a rolled, extruded or forged form, containing the elements, in weight percent, Si 0.8 to 1.3, Cu 0.2 to 1.0, Mn 0.5 to 1.1, Mg 0.45 to 1.0, Ce 0.01 to 0.25, and preferably added in the form of a Misch Metal, Fe 0.01 to 0.3, Zr<0.25, Cr<0.25, Zn<1.4, Ti<0.25, V<0.25, others each <0.05 and total <0.15, balance aluminium. The invention relates also to a method of manufacturing such an aluminium alloy product.

22 Claims, 1 Drawing Sheet

OTHER PUBLICATIONS

S. Pramanik et al. "Influence of Ce and Zr on the Ageing Behaviour of Thermo–Mechanically Processed Al–Mg–Si Alloys", BHM, 143. Jg. (1998) pp. 90–94.

J.W. Evancho et al. New 6XXX–series alloys for auto body sheet*), pp. 609–613 (1977).

Patent Abstracts of Japan Publication No. 63157831A, published Jun. 30, 1988, Applicant: Tokyo Alum KK.

* cited by examiner

WELDABLE HIGH STRENGHT AL-MG-SI ALLOY

FIELD OF THE INVENTION

This invention relates to an aluminium alloy suitable for use in aircraft, automobiles, and other applications and a method of producing such alloy. More specifically, it relates to an improved weldable aluminium product, particularly useful in aircraft applications, having high damage tolerant characteristics, including improved corrosion resistance, formability, fracture toughness and increased strength properties.

BACKGROUND OF THE INVENTION

It is known in the art to use heat treatable aluminium alloys in a number of applications involving relatively high strength such as aircraft fuselages, vehicular members and other applications. Aluminium alloys 6061 and 6063 are well known heat treatable aluminium alloys. These alloys have useful strength and toughness properties in both T4 and T6 tempers. As is known, the T4 condition refers to a solution heat treated and quenched condition naturally aged to a substantially stable property level, whereas T6 tempers refer to a stronger condition produced by artificially ageing. These known alloys lack, however, sufficient strength for most structural aerospace applications. Several other Aluminium Association ("AA") 6000 series alloys are generally unsuitable for the design of commercial aircraft which require different sets of properties for different types of structures. Depending on the design criteria for a particular aircraft component, improvements in strength, fracture toughness and fatigue resistance result in weight savings, which translate to fuel economy over the lifetime of the aircraft, and/or a greater level of safety. To meet these demands several 6000 series alloys have been developed.

European patent no. EP-0173632 concerns extruded or forged products of an alloy consisting of the following alloying elements, in weight percent:

Si 0.9–1.3, preferably 1.0–1.15

Mg 0.7–1.1, preferably 0.8–1.0

Cu 0.3–1.1,preferably 0.8–1.0

Mn 0.5–0.7

Zr 0.07–0.2, preferably 0.08–0.12

Fe <0.30

Zn 0.1–0.7, preferably 0.3–0.6 balance aluminium and unavoidable impurities (each <0.05, total <0.15).

The products have a non-recrystallised microstructure. This alloy has been registered under the AA designation 6056.

It has been reported that this known AA6056 alloy is sensitive to intercrystalline corrosion in the T6 temper condition. In order to overcome this problem U.S. Pat. No. 5,858,134 provides a process for the production of rolled or extruded products having the following composition, in weight percent:

Si 0.7–1.3

Mg 0.6–1.1

Cu 0.5–1.1

Mn 0.3–0.8

Zr <0.20

Fe <0.30

Zn <1

Ag <1

Cr <0.25 other elements <0.05, total <0.15 balance aluminium, and whereby the products are brought in an over-aged temper condition. However, over-ageing requires time and money consuming processing times at the end of the manufacturer of aerospace components. In order to obtain the improved intercrystalline corrosion resistance it is essential for this process that in the aluminium alloy the Mg/Si ratio is less than 1.

U.S. Pat. No. 4,589,932 discloses an aluminium wrought alloy product for e.g. automotive and aerospace constructions, which alloy was subsequently registered under the AA designation 6013, having the following composition, in weight percent:

Si 0.4–1.2, preferably 0.6–1.0

Mg 0.5–1.3, preferably 0.7–1.2

Cu 0.6–1.1

Mn 0.1–1.0, preferably 0.2–0.8

Fe <0.6

Cr <0.10

Ti <0.10 the balance aluminium and unavoidable impurities.

The aluminium alloy has the mandatory proviso that [Si+0.1]<Mg<[Si+0.4], and has been solution heat treated at a temperature in a range of 549 to 582° C. and approaching the solidus temperature of the alloy. In the examples illustrating the patent the ratio of Mg/Si is always more than 1.

U.S. Pat. No. 5,888,320 discloses a method of producing an aluminium alloy product. The product has a composition of, in weight percent:

Si 0.6–1.4, preferably 0.7–1.0

Fe <0.5, preferably <0.3

Cu <0.6, preferably <0.5

Mg 0.6–1.4, preferably 0.8–1.1

Zn 0.4 to 1.4, preferably 0.5–0.8 at least one element selected from the group:

Mn 0.2–0.8, preferably 0.3–0.5

Cr 0.05–0.3, preferably 0.1–0.2 balance aluminium and unavoidable impurities.

The disclosed aluminium alloy provides an alternative for the known high-copper containing 6013 alloy, and whereby a low-copper level is present in the alloy and the zinc level has been increased to above 0.4 wt. % and which is preferably in a range of 0.5 to 0.8 wt. %. The higher zinc content is required to compensate for the loss of copper.

In spite of these references, there is still a great need for an improved aluminium base alloy product having improved balance of strength, fracture toughness and corrosion resistance.

SUMMARY OF THE INVENTION

It is an object of the invention to provide a weldable 6000-series aluminium alloy wrought product having an improved balance of yield strength and fracture toughness.

It is another object of the invention to provide a weldable 6000-series aluminium alloy wrought product having an improved balance of yield strength and fracture toughness, while having a corrosion resistance, in particular intergranular corrosion resistance, at least equal or better than standard AA6013 alloy product in the same form and temper.

It is another object of the invention to provide a weldable 6000-series aluminium alloy rolled product having an improved balance of yield strength and fracture toughness, while having a corrosion resistance, in particular intergranular corrosion resistance, at least equal or better than standard AA6013 alloy product in the same form and temper.

According to the invention there is provided a weldable, high-strength aluminium alloy wrought product, which may be in the form of a rolled, extruded or forged form, containing the elements, in weight percent, Si 0.8 to 1.3, Cu 0.2 to 1.0, Mn 0.5 to 1.1, Mg 0.45 to 1.0, Ce 0.01 to 0.25, and preferably added in the form of a Misch Metal, Fe 0.01 to 0.3, Zr<0.25, Cr<0.25, Zn<1.4, Ti<0.25, V<0.25, others each <0.05 and total <0.15, balance aluminium.

DETAILED DESCRIPTION OF THE PREFERRED EMBODIMENTS

Figure 1:
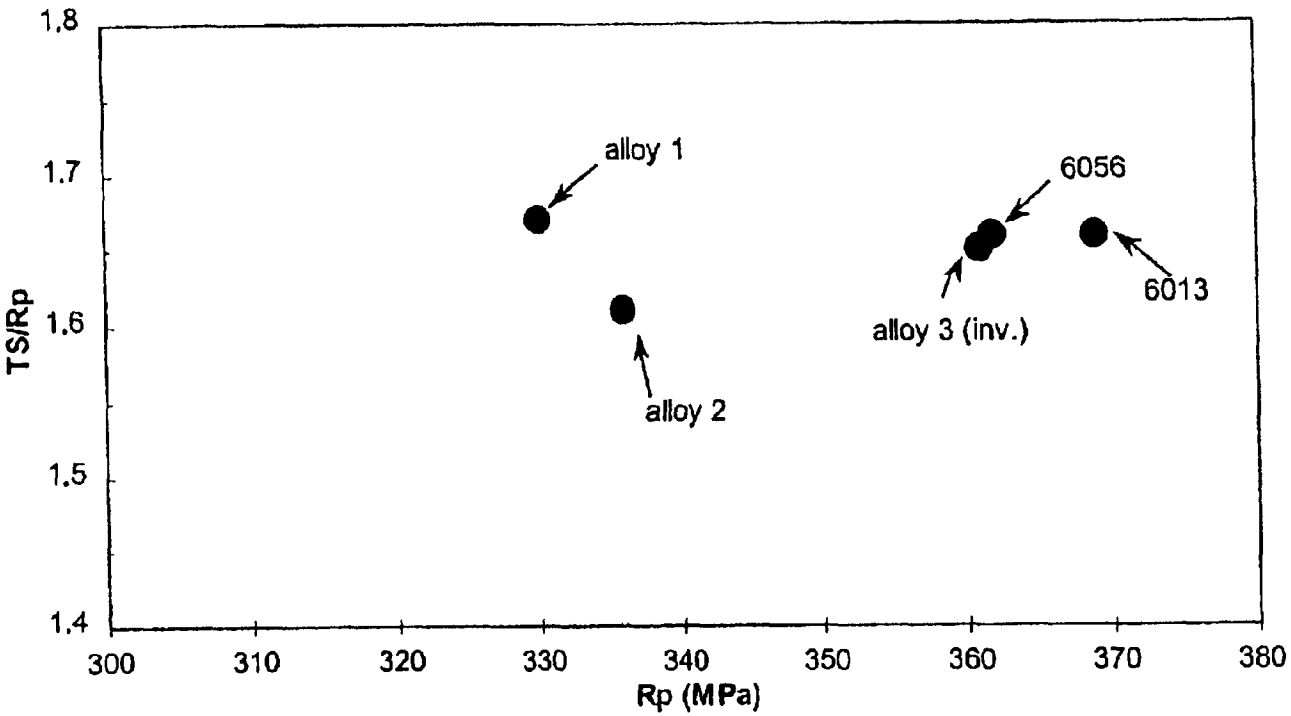
FIG. 1 shows schematically a ratio of TS/Rp against yield strength

By the invention we can provide an improved and weldable AA6000-series aluminium alloy wrought product, preferably in the form of a rolled product, having an improved balance in strength, fracture toughness and corrosion resistance, and intergranular corrosion resistance in particular. With the alloy product according to the invention we can provide a wrought product, preferably in the form of a rolled product, having a yield strength of 340 MPa or more and an ultimate tensile strength of 355 MPa or more, in combination with an improved intergranular corrosion performance compared to standard AA6013 alloys and/or AA6056 alloys when tested in the same form and temper. The alloy product may be welded successfully using techniques like e.g. laser beam welding, friction-stir welding and TIG-welding.

The product can either be naturally aged to produce an improved alloy product having good formability in the T4 temper or artificially aged to a T6 temper to produce an improved alloy having high strength and fracture toughness, along with a good corrosion resistance properties. A good balance in strength, fracture toughness and corrosion performance it being obtained without a need for bringing the product to an over-aged temper, but by careful selection of narrow ranges for the Ce, Cu, Mg, Si, and Mn-contents.

The balance of high formability, improved fracture toughness, high strength, and good corrosion resistance properties of the weldable aluminium alloy of the present invention are dependent in particular upon the chemical composition that is closely controlled within specific limits in more detail as set forth below. All composition percentages are by weight percent.

A preferred range for the silicon content is from 1.0 to 1.15% to optimise the strength of the alloy in combination with magnesium. A too high Si content has a detrimental influence on the elongation in the T6 temper and on the corrosion performance of the alloy.

Magnesium in combination with the silicon provides strength to the alloy. The preferred range of magnesium is 0.6 to 0.85%, and more preferably 0.6 to 0.75%. At least 0.45% magnesium is needed to provide sufficient strength while amounts in excess of 1.0% make it difficult to dissolve enough solute to obtain sufficient age hardening precipitate to provide high T6 strength.

Copper is an important element for adding strength to the alloy. However, too high copper levels in combination with Mg have a detrimental influence of the corrosion performance and on the weldability of the alloy. Depending on the application a preferred copper content is in the range of 0.25 to 0.5% as a compromise in strength, fracture toughness, formability and corrosion performance. It has been found that in this range the alloy product has a good resistance against IGC. In another embodiment the preferred copper content is in the range of 0.5 to 1.0% resulting in higher strength levels and improved weldability of the alloy product.

The preferred range of manganese is 0.6 to 0.8%, and more preferably 0.65 to 0.78%. Mn contributes to or aids in grain size control during operations that can cause the alloy to recystallise, and contributes to increase strength and fracture toughness.

A very important alloying element according to the invention is the addition of Ce in the range of 0.01 to 0.25%, and preferably in the range of 0.01 to 0.15%. In accordance with the invention it has been found that the addition of cerium results in a remarkable improvement of the fracture toughness of the alloy product, in particular when measured via a Kahn-tear testing, and thereby improving in particular the relation between fracture toughness and proof strength and resulting in increased application possibilities of the alloy product, in particular as aircraft skin material. The cerium addition may be done preferably via addition in the form of a Misch Metal ("MM") (rare earths with 50 to 60% cerium). The addition of cerium, mostly in the form of MM is known in the art to increase fluidity and the reduce die sticking in aluminium-silicon casting alloys. In aluminium casting alloys containing more than 0.7% of iron, it is reported to transform acicular $FeAl_3$ into a nonacicular compound.

The zinc content in the alloy according to the invention should be less than 1.4%. It has been reported in U.S. Pat. No. 5,888,320 that the addition of zinc may add to the strength of the aluminium alloy product, but it has been found also that too high zinc contents have a detrimental effect of the intergranular corrosion performance of the product. Furthermore, the addition of zinc tends to produce an alloy product having undesirable higher density, which is in particular disadvantageous when the alloy is being applied for aerospace applications. A preferred level of zinc in the alloy product according to the invention is less than 0.4%, and more preferably less than 0.25%.

Iron is an element having a strong influence on the formability and fracture toughness of the alloy product. The iron content should be in the range of 0.01 to 0.3%, and preferably 0.01 to 0.25%, and more preferably 0.01 to 0.2%.

Titanium is an important element as a grain refiner during solidification of the rolling ingots, and should preferably be less than 0.25%. In accordance with the invention it has been found that the corrosion performance, in particular against intergranular corrosion, can be remarkably be improved by having a Ti-content in the range of 0.06 to 0.20%, and preferably 0.07 to 0.16%. It has been found that the Ti may be replaced in part or in whole by vanadium.

Zirconium and chromium may be added to the alloy each in an amount of less than 0.25% to improve the recrystallisation behaviour of the alloy product. At too high levels the Cr present may form undesirable large particles with the Mg in the alloy product.

The balance is aluminium and inevitable impurities. Typically each impurity element is present at 0.05% maximum and the total of impurities is 0.15% maximum.

The best results are achieved when the alloy rolled products have a recrystallised microstructure, meaning that 80% or more, and preferably 90% or more of the grains in a T4 or T6 temper are recrystallised.

The product according to the invention is preferably therein characterised that the alloy having been aged to the T6 temper in an ageing cycle which comprises exposure to a temperature of between 150 and 210° C. for a period between 1 and 20 hours, thereby producing an aluminium alloy product having a yield strength of 340 MPa or more, and preferably of 350 MPa or more, and an ultimate tensile strength of 355 MPa or more, and preferably of 365 MPa or more.

Furthermore, the product according to the invention is preferably therein characterised that the alloy having been aged to the T6 temper in an ageing cycle which comprises exposure to a temperature of between 150 and 210° C. for a period between 1 and 20 hours, thereby producing an aluminium alloy product having an intergranular corrosion after a test according to MIL-H-6088 present to a depth of less than 200 $\mu$m, and preferably to a depth of less than 180 $\mu$m.

In an embodiment the invention also consists in that the product of this invention may be provided with at least one cladding. Such clad products utilise a core of the aluminium base alloy product of the invention and a cladding of usually higher purity which in particular corrosion protects the core. The cladding includes, but is not limited to, essentially unalloyed aluminium or aluminium containing not more than 0.1 or 1% of all other elements. Aluminium alloys herein designated 1xxx-type series include all Aluminium Association (AA) alloys, including the sub-classes of the 1000-type, 1100-type, 1200-type and 1300-type. Thus, the cladding on the core may be selected from various Aluminium Association alloys such as 1060, 1045, 1100, 1200, 1230, 1135, 1235, 1435, 1145, 1345, 1250, 1350, 1170, 1175, 1180, 1185, 1285, 1188, or 1199. In addition, alloys of the AA7000-series alloys, such as 7072 containing zinc (0.8 to 1.3%), can serve as the cladding and alloys of the AA6000-series alloys, such as 6003 or 6253, which contain typically more than 1% of alloying additions, can serve as cladding. Other alloys could also be useful as cladding as long as they provide in particular sufficient overall corrosion protection to the core alloy. In addition a cladding of the AA4000-series alloys can serve as cladding. The AA4000-series alloys have as main alloying element silicon typically in the range of 6 to 14%. In this embodiment the clad layer provides the welding filler material in a welding operation, e.g. by means of laser beam welding, and thereby overcoming the need for the use of additional filler wire materials in a welding operation. In this embodiment the silicon content is preferably in a range of 10 to 12%.

The clad layer or layers are usually much thinner than the core, each constituting 2 to 15 or 20 or possibly 25% of the total composite thickness. A cladding layer more typically constitutes around 2 to 12% of the total composite thickness.

In a preferred embodiment the alloy product according to the invention is being provided with a cladding thereon on one side of the AA1000-series and on the other side thereon of the AA4000-series. In this embodiment corrosion protection and welding capability are being combined. In this embodiment the product may be used successfully for example for pre-curved panels. In case the rolling practice of an asymmetric sandwich product (1000-series alloy+core+4000-series alloy) causes some problems such as banaring, there is also the possibility of first rolling a symmetrical sandwich product having the following subsequent layers 1000-series alloy+4000-series alloy+core alloy+4000-series alloy+1000-series alloy, where after one or more of the outer layer(s) are being removed, for example by means of chemical milling.

The invention also consists in a method of manufacturing the aluminium alloy product according to the invention. The method of producing the alloy product comprises the sequential process steps of: (a) providing stock having a chemical composition as set out above, (b) preheating or homogenising the stock, (c) hot working the stock, preferably by means of hot rolling (d) optionally cold working the stock, preferably by means of cold rolling (e) solution heat treating the stock, and (f) quenching the stock to minimise uncontrolled precipitation of secondary phases. Thereafter the alloy product can be provided in a T4 temper by allowing the product to naturally age to produce an improved alloy product having good formability, or can be provided in a T6 temper by artificial ageing. To artificial age, the product in subjected to an ageing cycle comprising exposure to a temperature of between 150 and 210° C. for a period between 0.5 and 30 hours.

The aluminium alloy as described herein can be provided in process step (a) as an ingot or slab for fabrication into a suitable wrought product by casting techniques currently employed in the art for cast products, e.g. DC-casting, EMC-casting, EMS-casting. Slabs resulting from continuous casting, e.g. belt casters or roll caster, may be used also.

Typically, prior to hot rolling the rolling faces of both the clad and the non-clad products are scalped in order to remove segregation zones near the cast surface of the ingot.

The cast ingot or slab may be homogenised prior to hot working, preferably by means of rolling and/or it may be preheated followed directly by hot working. The homogenisation and/or preheating of the alloy prior to hot working should be carried out at a temperature in the range 490 to 580° C. in single or in multiple steps. In either case, the segregation of alloying elements in the material as-cast is reduced and soluble elements are dissolved. If the treatment is carried out below 490° C., the resultant homogenisation effect is inadequate. If the temperature is above 580° C., eutectic melting might occur resulting in undesirable pore formation. The preferred time of the above heat treatment is between 2 and 30 hours. Longer times are not normally detrimental. Homogenisation is usually performed at a temperature above 540° C. A typical preheat temperature is in the range of 535 to 560° C. with a soaking time in a range of 4 to 16 hours.

After the alloy product is cold worked, preferably after being cold rolled, or if the product is not cold worked then after hot working, the alloy product is solution heat treated at a temperature in the range of 480 to 590° C., preferably 530 to 570° C., for a time sufficient for solution effects to approach equilibrium, with typical soaking times in the rang of 10 sec. to 120 minutes. With clad products, care should be taken against too long soaking times to prevent diffusion of alloying element from the core into the cladding detrimentally affecting the corrosion protection afforded by said cladding.

After solution heat treatment, it is important that the alloy product be cooled to a temperature of 175° C. or lower, preferably to room temperature, to prevent or minimise the uncontrolled precipitation of secondary phases, e.g. $Mg_2Si$. On the other hand cooling rates should not be too high in order to allow for a sufficient flatness and low level of residual stresses in the alloy product. Suitable cooling rates can be achieved with the use of water, e.g. water immersion or water jets.

The product according to the invention has been found to be very suitable for application as a structural component of an aircraft, in particular as aircraft fuselage skin material.

EXAMPLE

Five different alloys have been DC-cast into ingots, then subsequently scalped, pre-heated for 6 hours at 550° C. (heating-up speed about 30° C./h), hot rolled to a gauge of 8 mm, cold rolled to a final gauge of 2.0 mm, solution heat treated for 15 min. at 550° C., water quenched, aged to a T6-temper by holding for 4 hours at 190° C. (heat-up speed about 35° C./h), followed by air cooling to room temperature. Table 1 gives the chemical composition of the alloys cast, balance inevitable impurities and aluminium, and whereby Alloy no. 3 is the alloy according to the invention and the other alloys are for comparison. The 0.03 wt. % cerium has been added to the melt via the addition of 0.06 wt. % of MM having 50% of cerium.

The tensile testing has been carried out on the bare sheet material in the T6-temper and having a fully recystallised microstructure. For the tensile testing in the L-direction small euro-norm specimens were used, average results of 3 specimens are given, and whereby "Rp" stands for yield strength, "Rm" for ultimate tensile strength, and A50 for elongation. The results of the tensile tests have been listed in Table 2. The "TS" stands for tear strength, and has been measured in the L-T direction in accordance with ASTM-B871-96. "UPE" stands for Unit Propagation Energy, and has been measured in accordance with ASTM-B871-96, and is a measure for toughness, in particular for the crack growth, and whereas TS is in particular a measure for crack initiation. Intergranular corrosion ("ICG") was tested on two specimens of 50×60 mm in accordance with the procedure given in AIMS 03-04-000, which specifies MIL-H-6088 and some additional steps. The maximum depth in microns has been reported in Table 4.

FIG. 1 shows schematically the ratio of TS/Rp against the yield strength.

From the results of Table 2 it can be seen that adding cerium in accordance with the invention results in a significant increase in strength levels, in particular the yield strength of the alloy product (see Alloy 1 and 3). From the results of Table 3 it can be seen that adding cerium results in a significant increase of the fracture toughness of the alloy product when tested in the L-T direction (see Alloy 1 and 3). Only a very small increase in fracture toughness can be found when adding zirconium instead of cerium to the alloy. The shown strength increase was expected for the addition of 0.11% of zirconium. Alloys 1, 2 and 3 have a somewhat lower strength and fracture toughness than standard 6056 and 6013 alloy, which is to a large extent due to a significantly lower copper content in the aluminium alloys tested. When the TS/Rp-ratio is plotted against the yield strength, see FIG. 1, it can be seen that the addition of even small amounts of cerium results in a significant increase in the balance between fracture toughness and yield strength, which increase is a desirable property for various applications, in particular in aerospace constructions.

From the results of Table 4 it can be seen that the addition of cerium in accordance with the invention has no significant influence on the performance against intergranular corrosion compared to aluminium alloy products having an almost similar chemical composition apart from the cerium addition while being in the same temper. However, the performance of Alloy no. 3 against intergranular corrosion is significantly better compared to standard 6056 and 6013 alloy products, whereas Alloy no. 3 has a yield strength and a TS/Rp-ratio close to the results of standard 6056 and 6013 alloy products in the same temper. It is believed that an increase of the Ti-content to for example 0.1 wt. % in the aluminium alloy product according to the invention would result in a reduction of the maximum intergranular corrosion depth. Furthermore, it is believed that optimising the T6 temper ageing treatment would also result in an improved resistance against intergranular corrosion.

Having now described the invention, it will be apparent to one of ordinary skill in the art that many changes and modifications can be made without departing from the spirit or scope of the invention as herein described.

TABLE 1

Chemical composition of the alloys tested.

| Alloy | Si | Fe | Cu | Mn | Mg | Zn | Ti | Zr | Ce |
|---|---|---|---|---|---|---|---|---|---|
| 1 (comp) | 1.13 | 0.16 | 0.51 | 0.62 | 0.69 | 0.16 | 0.01 | — | — |
| 2 (comp) | 1.20 | 0.18 | 0.52 | 0.72 | 0.69 | 0.15 | 0.04 | 0.11 | — |
| 3 (inv.) | 1.17 | 0.16 | 0.48 | 0.67 | 0.69 | 0.15 | 0.01 | — | 0.03 |
| standard 6056 | 0.92 | 0.15 | 0.90 | 0.46 | 0.88 | 0.08 | 0.02 | — | — |
| standard 6013 | 0.79 | 0.17 | 0.96 | 0.35 | 0.90 | 0.09 | 0.03 | — | — |

TABLE 2

Tensile properties in the L-direction in T6-temper sheet material.

| Alloy | Rp [MPa] | Rm [MPa] | A50 [%] |
|---|---|---|---|
| 1 | 330 | 358 | 8.5 |
| 2 | 336 | 364 | 7.0 |
| 3 | 361 | 379 | 6.5 |
| standard 6056 | 362 | 398 | 12 |
| standard 6013 | 369 | 398 | 9 |

TABLE 3

Fracture toughness results in the L-T direction.

| Alloy | L-T TS [MPa] | UPE [kJ] | TS/Rp |
|---|---|---|---|
| 1 | 552 | 207 | 1.67 |
| 2 | 564 | 208 | 1.68 |
| 3 | 595 | 211 | 1.65 |
| standard 6056 | 590 | 215 | 1.66 |
| standard 6013 | 593 | 184 | 1.66 |

TABLE 4

ICG corrosion results in the T6-temper.

| Alloy | Depth of max. [μm] |
|---|---|
| 1 | 137 |
| 2 | 127 |
| 3 (inv.) | 134 |
| standard 6056 | 190 |
| standard 6013 | 190 |

What is claimed is:

1. Weldable, high-strength aluminium alloy wrought product, containing the elements, in weight percent:

Si 0.8–1.3

Cu 0.5 to 1.0

Mn 0.65–1.1

Mg 0.45–1.0

Ce 0.01–0.25,

Fe 0.01–0.3

Zr<0.25

Cr<0.25

Zn<1.4

Ti<0.25

V<0.25 others each <0.05, total <0.15 balance aluminium, wherein the product is in the form of a rolled product.

2. Product in accordance with claim 1, wherein the Si level is in the range of 1.0 to 1.15%.

3. Product in accordance with claim 1, wherein the Mn level is in the range of 0.65 to 0.8%.

4. Product in accordance with claim 1, wherein the Mg level is in the range of 0.6 to 0.85%.

5. Product in accordance with claim 1, wherein the Ti level is in the range of 0.06 to 0.2%.

6. Product in accordance with claim 1, wherein the Zn level is in a range of less than 0.4%.

7. Product in accordance with claim 1, wherein the Fe level is in the range of 0.01 to 0.25%.

8. Product in accordance with claim 1, wherein the Ce level is in the range of 0.01 to 0.15%.

9. Product is accordance with claim 1, wherein the product has a more than 80% recrystallised microstructure.

10. Product in accordance with claim 1, wherein the alloy having been aged to the T6 temper in an ageing cycle which comprises exposure to a temperature of between 150 and 210° C. for a period between 0.5 and 30 hours, to thereby produce an aluminium alloy product characterised by an intergranular corrosion after an MIL-H-6088 test which is present to a depth less than 200 $\mu$m.

11. Product in accordance with claim 1, wherein the product has a single or multiple cladding thereon selected from the group consisting of:

(i) the cladding is of a higher purity aluminium alloy than said product;

(ii) the cladding is of the Aluminium Association AA1000-series;

(iii) the cladding is of the Aluminium Association AA4000-series;

(iv) the cladding is of the Aluminium Association AA6000-series; and (v) the cladding is of the Aluminium Association AA7000-series.

12. Product in accordance with claim 11, wherein the alloy product has a cladding thereon on one side of the Aluminium Association AA1000-series and on the other side thereon of the Aluminium Association AA4000-series.

13. Product in accordance with claim 1, wherein the Ce is added as a MM.

14. Product in accordance with claim 1, wherein the Mn level is in the range of 0.65 to 0.78%.

15. Product in accordance with claim 1, wherein the Mg level is in the range of 0.6 to 0.75%.

16. Product in accordance with claim 1, wherein the Ti level is in the range of 0.07 to 0.2%.

17. Product in accordance with claim 1, wherein the Fe level is in the range of 0.01 to 0.2%.

18. Product in accordance with claim 1, wherein the product is a structural component of an aircraft.

19. Product in accordance with claim 1, wherein the product is aircraft skin material.

20. Product manufactured by a method comprising the sequential steps of:

(a) providing stock having a chemical composition according to claim 1, (b) preheating or homogenising the stock, (c) hot working the stock, (d) optionally cold working the stock, solution heat treating the stock, (e) quenching the stock to minimise uncontrolled precipitation of secondary phases, and (f) ageing the quenched stock to provide an alloy product in a T4 temper or in a T6 temper, wherein the product is a structural component of an aircraft.

21. Product manufactured by a method comprising the sequential steps of:

(a) providing stock having a chemical composition according to claim 1, (b) preheating or homogenising the stock, (c) hot working the stock, (d) optionally cold working the stock, solution heat treating the stock, (e) quenching the stock to minimise uncontrolled precipitation of secondary phases, and (f) ageing the quenched stock to provide an alloy product in a T4 temper or in a T6 temper, wherein the product is aircraft skin material.

22. Product in accordance with claim 1, wherein said product comprises zero weight-percent of Zr.

* * * * *